US006105804A

United States Patent [19]

Stoffer

[11] Patent Number: 6,105,804

[45] Date of Patent: Aug. 22, 2000

[54] COLLAPSIBLE PARTS SHIPPING AND STORAGE CONTAINER

[75] Inventor: Gary L. Stoffer, Bedford, Pa.

[73] Assignee: Hedstrom Corporation, Bedford, Pa.

[21] Appl. No.: 09/388,513

[22] Filed: Sep. 2, 1999

[51] Int. Cl.[7] ..... B65D 88/20

[52] U.S. Cl. ..... 220/9.4; 220/495.11; 220/495.08; 220/4.33; 200/511; 200/512

[58] Field of Search ..... 220/9.4, 495.8, 220/495.11, 4.33; 206/512, 511

[56] References Cited

U.S. PATENT DOCUMENTS

| | | | |
|---|---|---|---|
| 2,215,695 | 9/1940 | Ginsbeg | 206/7 |
| 2,517,757 | 8/1950 | Alderstein | 312/3 |
| 3,105,617 | 10/1963 | Felldin | 220/9.4 |
| 3,888,486 | 6/1975 | Sutter et al. | 273/105 |
| 4,109,692 | 8/1978 | Brown | 150/52 |
| 4,705,246 | 11/1987 | Wolf | 220/9.4 |
| 5,024,344 | 6/1991 | Paula | 220/9.3 |
| 5,268,969 | 12/1993 | Duran, Jr. | 383/22 |
| 5,437,384 | 8/1995 | Farrell | 220/9.4 |
| 5,645,353 | 7/1997 | Linnell et al. | 220/9.4 |
| 5,735,608 | 4/1998 | Branco | 383/25 |
| 5,764,343 | 6/1998 | Waltke et al. | 220/9.2 |

*Primary Examiner*—Joseph M. Moy
*Attorney, Agent, or Firm*—Cesari and McKenna, LLP

[57] ABSTRACT

A collapsible shipping and storage container includes a collapsible exterior frame which supports a durable heavy-duty flexible bag within the confines of the frame. The bag has an open top through which parts may be tossed to fill the interior of the bag and an opening is provided in a wall of the bag for providing side access to the interior of the bag so that personnel can remove parts from the bag as they are needed. A closure is provided for that opening which can be opened from the top of the bag downward so that the bag may be accessed at progressively lower locations on the bag as the bag is emptied. When erected, the container frame is a sturdy structure so that a plurality of containers can be stacked. The frame is also collapsible so that when the associated bag is empty, the container can be collapsed and stacked with other similarly collapsed containers so that several collapsed containers can occupy the same space as a single erect container.

14 Claims, 4 Drawing Sheets

COLLAPSIBLE PARTS SHIPPING AND STORAGE CONTAINER

This invention relates to a container. It relates more particularly to a container specifically designed for shipping and storing bulk components and commodities.

BACKGROUND OF THE INVENTION

In product manufacture, considerable time and effort is involved in handling the components and parts which make up a particular product. In some cases, a part made by an outside supplier must be transported to the OEM assembling the product. In those instances where the OEM also makes the parts, there is inevitably intraplant transportation of parts from one place to another within the plant. Also, to ensure a steady product output, a substantial inventory of the various parts comprising the product must be maintained.

Conventionally, such loose parts are stored in bulk and transported in large cardboard cartons which are moved about from one place to another on pallets using a forklift. For transportation over long distances via a truck, trailer or other mobile container, the cartons are carried to the container by a forklift and stacked on their respective pallets inside the container, filling the container as much as possible. When the container reaches its destination, the cartons must be offloaded using a forklift and carried to a storage location where they are again arranged in stacks until the parts are needed for the product assembly process. At that point, a carton may be delivered by a forklift to an assembly location where the parts are withdrawn from the carton as needed.

In the course of transporting and stacking the cardboard cartons, the cartons are often deformed and weakened to the point where they sometimes split open disgorging their contents onto the floor or ground. Also, being relatively weak structures, the cartons cannot be stacked more than two or three cartons high without additional racking or support. In other words, without such additional support, the cartons lower down in the stack will collapse under the weight of those above. As a result, there is a substantial amount of wasted space in the trucks or other containers which transport the filled cartons from one place to another and in the warehouse storage spaces provided for such cartons.

Also, in order to reuse undamaged cartons, the cartons must be transported back to their point of origin. Since the cartons cannot readily be collapsed, they take up the same amount of space in the return container even though the cartons are empty.

Finally, when cartons become too damaged for reuse, they must be cut up and disposed of in a landfill or by burning, neither of which is an environmentally friendly mode of disposal.

SUMMARY OF THE INVENTION

Accordingly, it is an object of the present invention to provide an improved container for shipping and storing small parts and commodities.

Another object of the invention is to provide a container of this type which can be reused over and over again without material degradation.

A further object of the invention is to provide such a container which is strong enough to withstand stacking without additional racking.

A further object of the invention is to provide a parts shipping container which is collapsible when empty so that a large number of empty containers can be stacked and transported in a minimum amount of space.

A further object of the invention is to provide a returnable parts shipping container which is relatively easy and inexpensive to make in quantity.

Other objects will, in part, be obvious and will, in part, appear hereinafter.

The invention accordingly comprises the features of construction, combination of elements and arrangement of parts which will be exemplified in the construction hereinafter set forth, and the scope of the invention will be indicated in the claims.

Briefly, the present container comprises a strong, rigid, exterior frame which supports a durable, heavy duty, flexible bag within the confines of the frame. The bag has an open top through which parts and components may be tossed to fill the interior of the bag. Also, means are provided in at least one wall of the bag for providing side access to the interior of the bag so that pickers or other personnel can remove parts easily from the bag as they are needed. Preferably, a closure is provided for that side opening which can be opened from the top of the bag downward so that the bag may be accessed at progressively lower locations on the bag as the bag contents become depleted.

The container frame is a sturdy rectangular structure so that when the bags are full, the containers can be stacked without any need for pallets or racking. Therefore, the container can be dimensioned so that when stacked in large numbers, the containers will fill most of the volume of a mobile container or storage space so that a maximum number of containers can be shipped at any one time and stored in a minimum amount of space.

Yet the frame is also collapsible so that when the associated bag is empty, the container can be collapsed and stacked with other similarly collapsed containers for shipment back to the point of origin with maximum spatial efficiency.

As we shall see, the components of applicant's returnable shipping and storage container are relatively inexpensive to make in quantity and can be assembled easily and erected by relatively unskilled personnel. Therefore, the container should find wide acceptance in the marketplace.

BRIEF DESCRIPTION OF THE DRAWINGS

For a fuller understanding of the nature and objects of the invention, reference should be had to the following detailed description taken in connection with the accompanying drawings, in which.

DETAILED DESCRIPTION OF AN ILLUSTRATIVE EMBODIMENT

Figure 1:
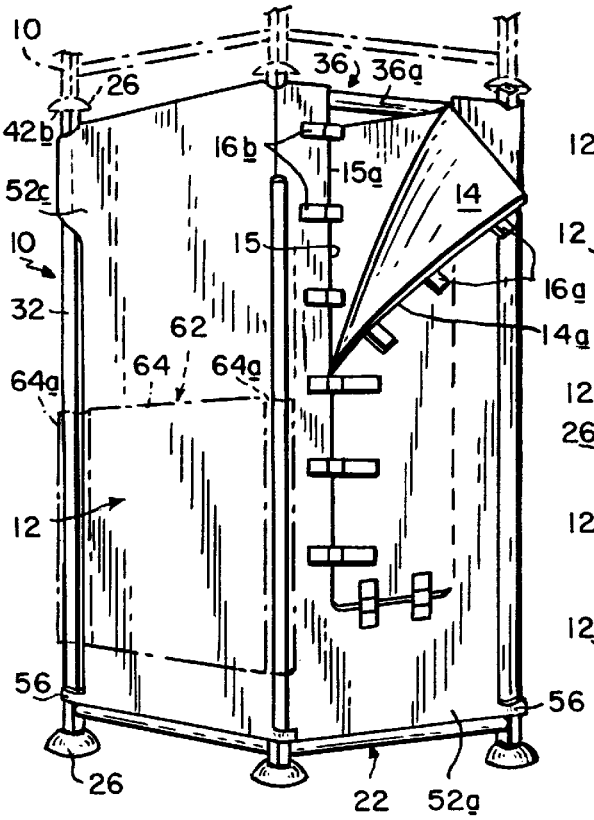
FIG. 1 is a right front perspective view of a collapsible returnable parts shipping and storage container incorporating the invention, the container being shown in its erect condition.

Referring to FIG. 1 of the drawings, my container comprises a strong, sturdy, rectilinear frame shown generally at 10 and a durable, heavy-duty flexible bag 12, the bag being suspended from the top of frame 10 so that when the container is in its erect condition shown in FIG. 1, the bag hangs down substantially within the envelope defined by the frame 10.

As shown in FIG. 1, bag 10 has an open top so that it can be filled with parts by dropping or tossing the parts into the top of the bag. When filled, the container may be moved to a storage location or to a truck, trailer or other transport container using a forklift whose fork can be engaged directly under frame 10. In other words, no pallets are required. As will be described in more detail later, frame 10 is designed so that filled containers can be stacked stably one on top of the other as shown in phantom in FIG. 1. When a multiplicity of containers are so stacked, they occupy a minimum amount of space. As an example, a typical filled container is in the order of 68 inches wide, 67 inches deep and 102 inches high. As such, it can hold 5 to 6 gaylords of parts so that eighteen containers can fully utilize a standard 53 foot trailer thereby optimizing the number of parts per truck load. With its space-saving construction, my container can result in substantially reduced freight and handling costs associated with intraplant and interplant movement of parts, trailer loading and unloading, as well as a reduction in other costs associated with the use of conventional cardboard cartons, such as landfill charges for disposing of the cartons.

Still referring to FIG. 1, when the container has reached its destination and it is time to withdraw parts from bag 12, a closure 14 in a wall of the bag, e.g., the front wall, may be opened allowing assemblers, pickers or other personnel to gain access to the interior of the bag through an opening 15 in that wall. The illustrated closure 14 is in the form of a flap incorporated into the front wall of the bag 12. The flap has a free vertical edge 14*a* which extends from the top of the bag to a point near the bottom of the bag. Attached to that edge is a series of vertically spaced fasteners 16*a* which can be releasably secured to mating fasteners 16*b* on an opposing vertical edge 15*a* of opening 15. Similar fasteners may be present at the bottom of closure 14 as shown. The fasteners 16*a*, 16*b* may be straps and buckles, hook and loop fasteners, snap fasteners or the like. To access the parts in bag 12, the uppermost fasteners 16*a*, 16*b* may be released to open the uppermost portion of the closure 14 and as the level of parts in the bag drops, the fasteners further down on the bag may be released allowing the lower portions of the closure to be folded back to provide access to the interior of the bag at a lower level and so on until all of the fasteners are released and the closure is open along its entire vertical extent thereby providing access to the parts at the bottom of the bag 12.

Figure 2:
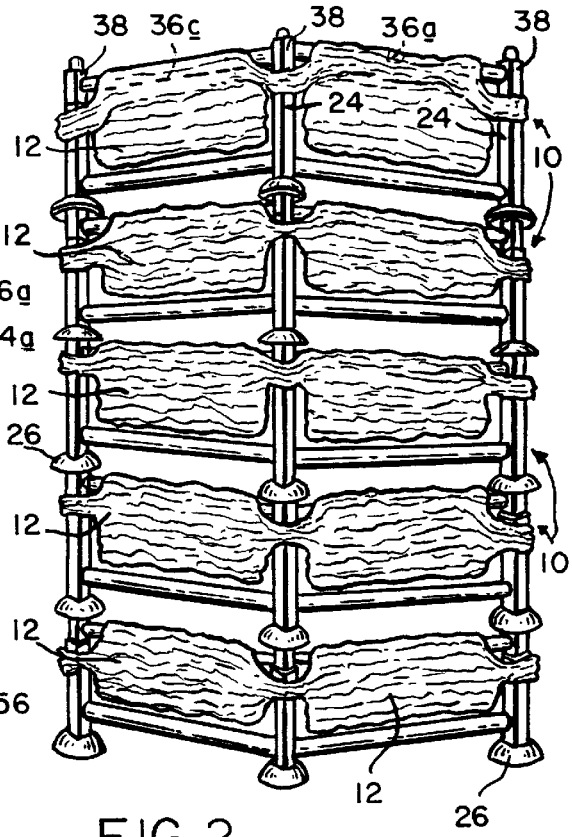
FIG. 2 is a similar view showing a stack of FIG. 1 containers in their collapsed condition.

When bag 12 is empty, frame 10 may be disassembled and the container collapsed to the condition illustrated in FIG. 2 which shows a stack of similarly collapsed containers. As seen from FIGS. 1 and 2, five collapsed containers occupy substantially the same volume as a single erect container. Up to eighteen of these five unit-high stacks can fit in a standard 53 foot trailer so that up to ninety empty containers can make the return trip in the trailer that delivered the eighteen filled containers. As we shall see, using a standard forklift, each container can be disassembled and collapsed quite easily in a minimum amount of time for the return shipment.

Figure 4:
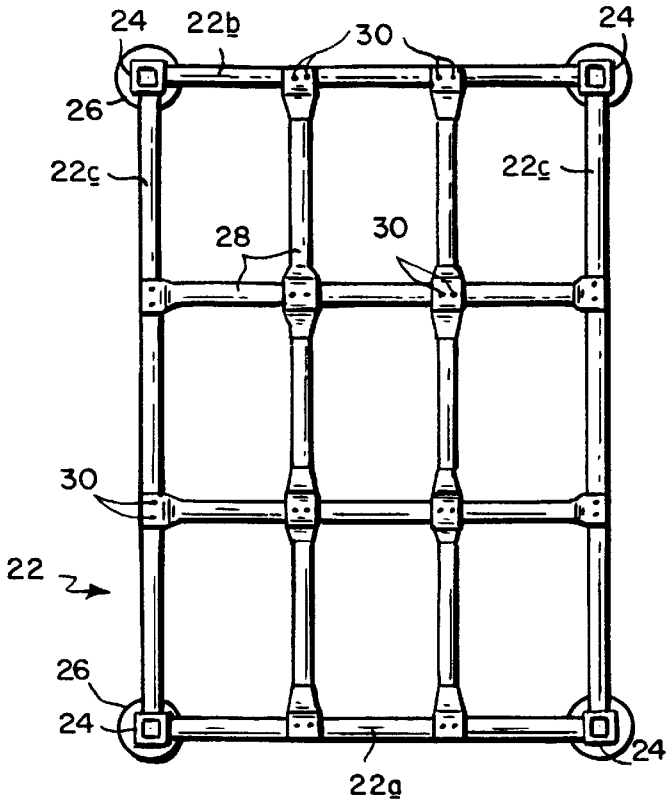
FIG. 4 is a plan view taken along line 4—4 of FIG. 3.
Figure 3:
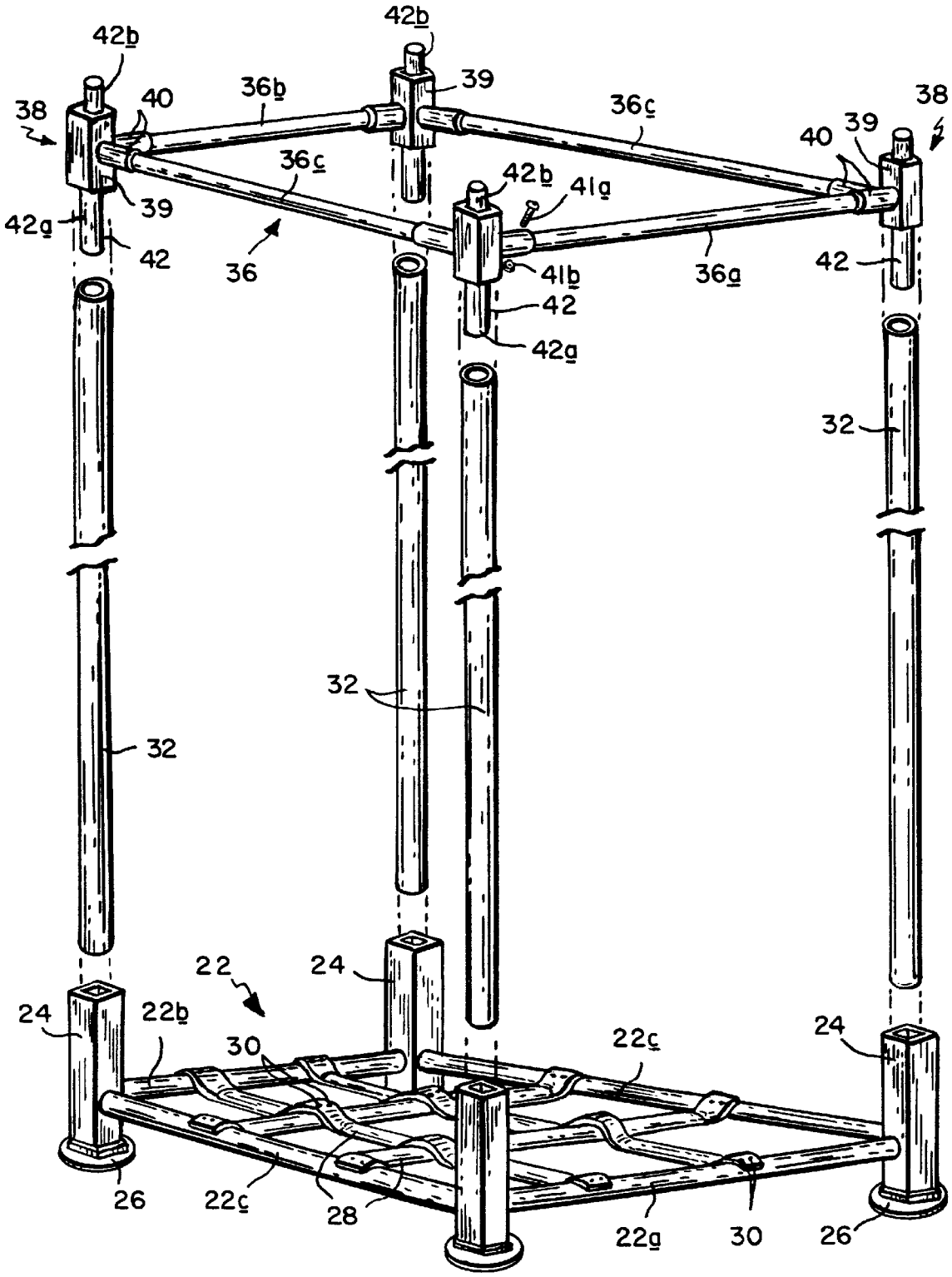
FIG. 3 is an exploded perspective view showing in greater detail the frame component of the FIG. 1 container.

Referring to FIGS. 3 and 4, frame 10 comprises a bottom section or base 22. That base has a front rail 22*a*, a rear rail 22*b* and opposite side rails 22*c*, 22*c* that define a rectangle. Vertical legs 24 are welded to the adjacent ends of the rails at the corners of the rectangle and welded to the lower end of each post is a hemispherical or inverted cup-like foot 26. In order to rigidify base 22 and prevent it from racking, a plurality of orthogonal stringers 28 extend between the front and rear rails 22*a* and 22*b* and between the side rails 22*c*, to form a grid with the stringers being flattened and welded to the adjacent rails and to each other by welds 30 as best seen in FIG. 4.

Preferably, the rails and stringers are cylindrical tubes and the legs 24 are tubes with square cross sections.

Frame 10 also includes four tubular columns 32. The columns are cylindrical with an outside diameter which is sized with relation to legs 24 such that the lower ends of the columns can plug into the upper ends of legs 24 with a relatively snug fit so that when assembled to the base, the columns project up vertically at the four corners of the base.

The final component of frame 10 is a top section shown generally at 36 comprising a front rail 36*a*, a rear rail 36*b* and a pair of opposite side rails 36*c*, 36*c* all arranged to form a rectangle. The adjacent ends of the rails are connected to vertical corner brackets 38 at the four corners of the rectangle.

As shown in FIG. 3, each corner bracket 38 comprises a vertical tubular post 39 having a square cross section, i.e., a shorter version of leg 24. Welded to the post is a pair of orthogonal sockets 40 for receiving the ends of the adjacent rails 36*a*, 36*b* and 36*c*. The rails may be releasably secured in their sockets by bolts 41*a* extending through aligned holes in the sockets and rails and nuts 41*b* tightened onto the ends of those bolts.

Extending down through the post 39 of each bracket 38 is a cylindrical tube 42 which is fixed in place within the bracket by welds or other suitable means such that a relatively long segment 42*a* of tube 42 projects from the bottom of the associated bracket while a shorter tube segment 42*b* projects from the upper end of the bracket. Furthermore, the outer diameter of each tube 42 is slightly less than the inner diameter of tubular columns 32 so that the tubes 42 can be plugged into the upper ends of those columns at the four corners of the frame section 36, the posts 39 acting as stops which engage the tops of the columns. Thus, when frame 10 is fully assembled as shown in FIG. 1, it constitutes a sturdy rectilinear structure which is resistant to bending, twisting and racking.

When the frame 10 is in its erect condition shown in FIG. 1, the top section 36 is separated from base 22 by columns 32. The frame may be reconfigured from that erect condition to the collapsed condition illustrated in FIG. 2 by removing columns 32 and lowering top section 36 so that the tubes 42 plug into the legs 24 of base 22.

Further in accordance with the invention, whether frame 10 is in its erect or collapsed condition, the frames 10 can be stacked one on top of the other so that the cup-like feet 26 of an upper frame in the stack seat on the tube segments 42*b* in the top section 36 of the underlying frame. Thus, a plurality of containers can form a stack which is quite stable.

Figure 5:
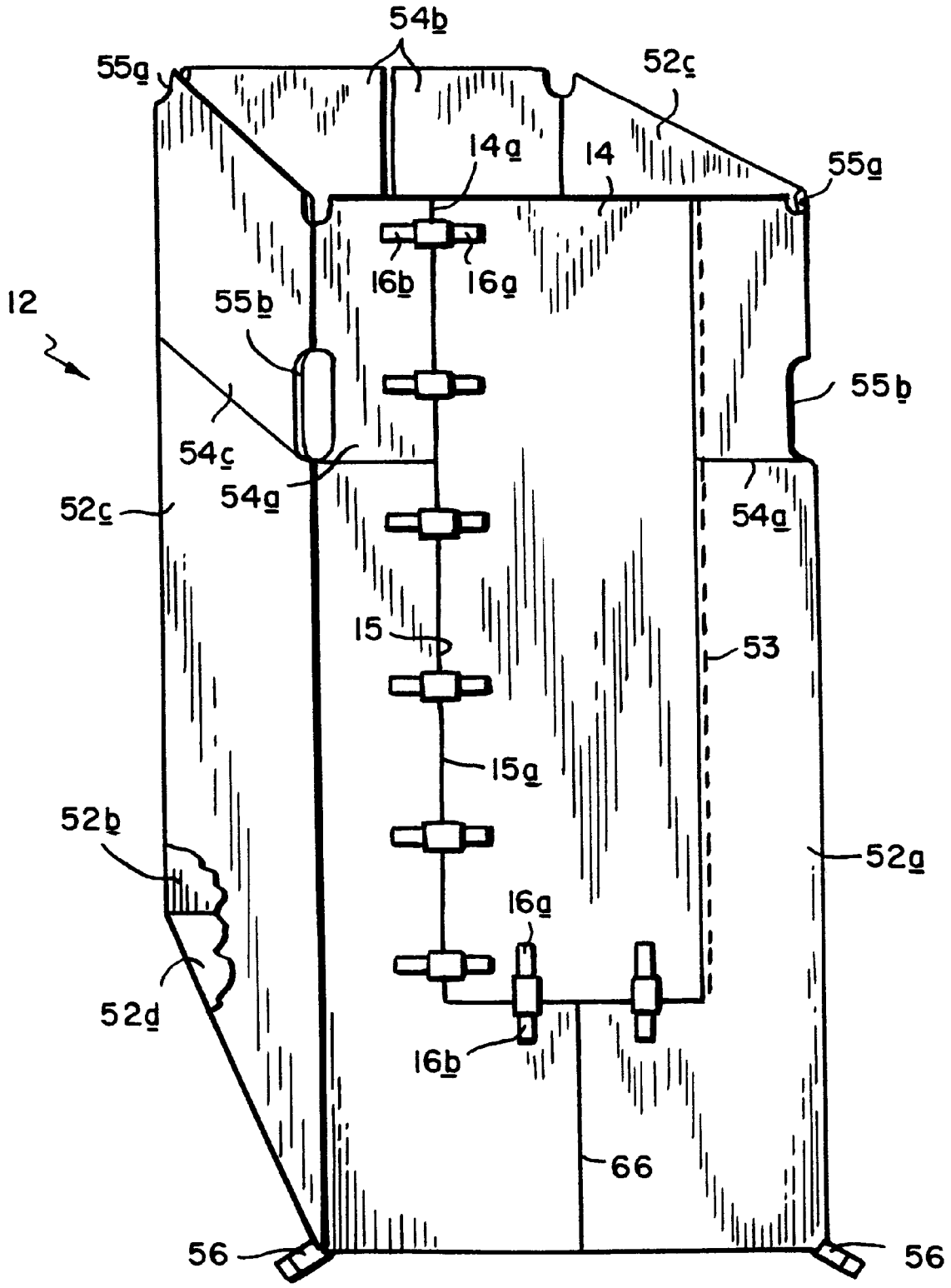
FIG. 5 is a right front perspective view of the bag component of the FIG. 1 container.

Referring now to FIG. 5, the bag 12 has a front wall 52*a*, a rear wall 52*b*, a pair of opposite side walls 52*c*, 52*c* and a bottom wall 52*d*. The opening 15 is formed in the front wall 52*a* with the closure 14 being constituted by a rectangular panel stitched along a side margin thereof to wall 52*a* by vertical stitching 53. The bag is made of very strong material, e.g., woven polypropylene, so that it can contain a heavy load, e.g., over 2500 lbs.

To suspend the front wall 52*a* of bag 12 from frame 10, a pair of relatively large front hems 54*a* are provided at the top of wall 52*a* on opposite sides of opening 15. The hems 54*a* are arranged to receive or engage around front rail 36*a* of frame top section 36 is (FIG. 3). Similar pair of large rear hems 54*b* are provided at the top of the bag rear wall 52*b* which are adapted to engage around rear rail 36*b* of the frame section to support the rear wall of the bag. The opposite side walls 52*c*, 52*c* of bag 12 are adapted to be suspended from frame 10 in a similar fashion by means of large side hems 54*c*, at the tops of those walls, those hems being adapted to engage around the side rails 36*c*, 36*c* of frame top section 36. A set of holes 55*a* are provided at the tops of hems 54*a* to 54*c* at the four corners of the bag 12 to provide clearance for tube segments 42*b*. A similar set of holes 55*b* in the outer walls of those hems below holes 55*a* provides clearance for columns 32. Thus, bag 12 is designed so that its upper end can be supported by frame 10 around substantially the entire perimeter of the bag as shown in FIG. 1. Finally, narrow loops 56 are provided at the bottom four corners of the bag 12. These loops are dimensioned to engage around the legs 24 of the frame base 22 as shown in FIG. 1.

Figure 6:
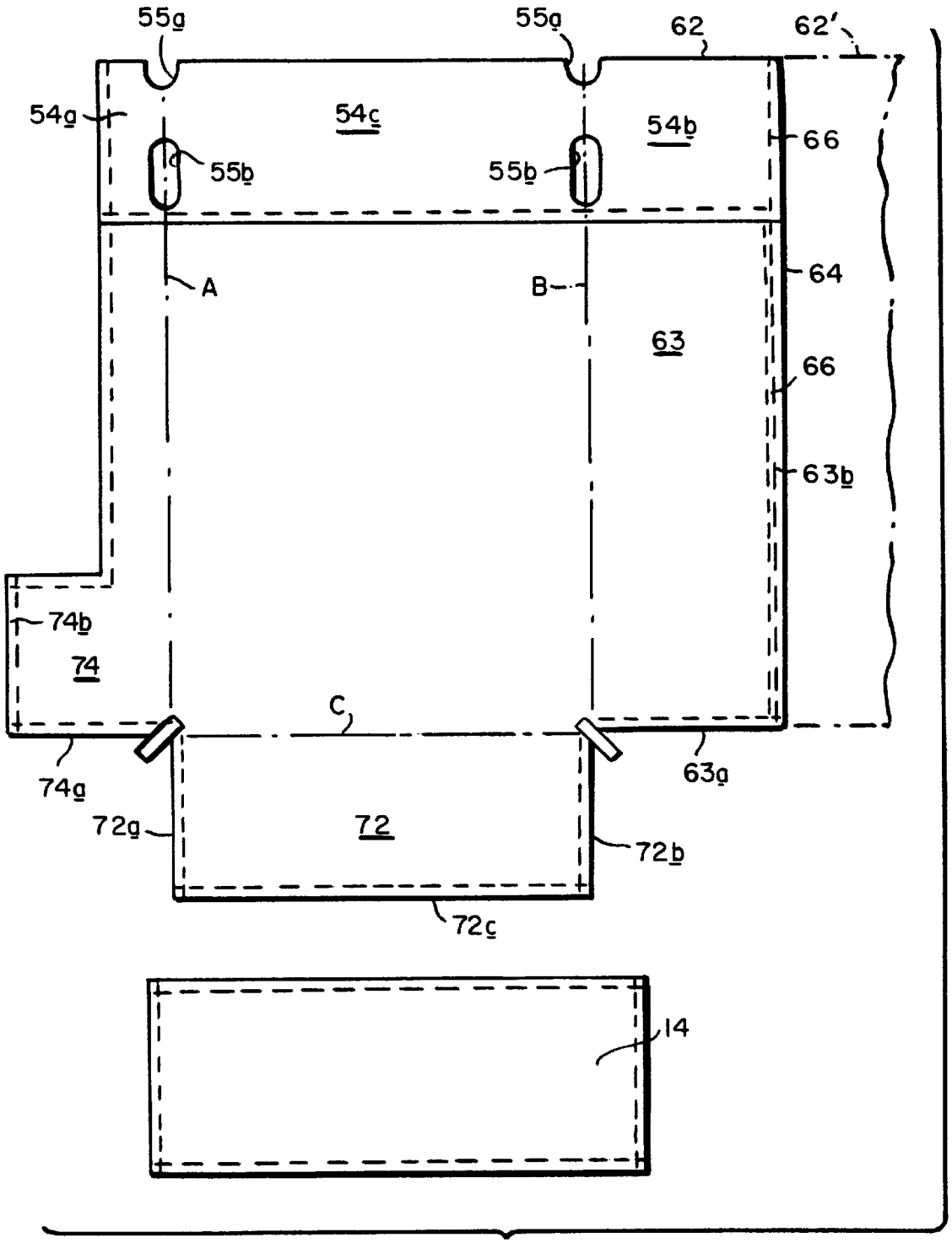
FIG. 6 is a plan view showing a hemmed pattern or blank for making the FIG. 5 bag.

Preferably, bag 12 has lateral symmetry so that the bag can be produced from a pair of mirror image bag material patterns or blanks and assembled with a minimum amount of stitching. A typical hemmed blank is illustrated in FIG. 6. As seen there, blank 62 comprises a generally rectangular panel 63 having a lower edge 63*a* and a vertical side edge 63*b* which is connected by stitching 66 to the corresponding edge of a second mirror image blank 62' shown in phantom in FIG. 6. Each blank has a large hem extending along its top edge which forms one of the front hems 54*a*, one of the back hems 54*b* and one of the side hems 54*c* of the bag depicted in FIG. 5. The hemmed holes 55*a* and 55*b* are present in each blank.

The blank 62 also includes a rectangular panel extension 72 at the bottom of panel 63 which forms one half of the bag bottom wall 52*d*. A second smaller rectangular panel extension 74 having a lower edge 74*a* at the side of panel 63 forms one half of the portion of the bag front wall 52*a* below opening 15 therein.

Bag 12 is constructed by folding blank 62 along the fold lines A, B & C in FIG. 6, stitching the opposite ends 72*a* and 72*b* of panel extension 72 to the adjacent lower edges 74*a* and 63*a* of panels 74 and 63, respectively, and then connecting by suitable stitching 66 the panel side edge 63*b*, the horizontal edge 72*c* of panel extension 72 and the vertical edge 74*b* of panel extension 74 to the corresponding edges of the other blank 62'. Preferably, no stitching 66 connects the panels 62 and 62' at hems 54*b* in FIG. 6 so that there are two separate hems 54*b*.

To assemble or erect the illustrated container, the frame top section 36 is partially assembled leaving the brackets 38 at the front (or rear) of the frame section disengaged from the side rails 36*c*. Then, the bag hems 54*b* and 54*c* are slid over the rails 36*a* and 36*b*, respectively, and the loops 54*a* are slid over the front rail 36*a*. The various hems are large or tall enough to provide clearance for the corner brackets 38 including the tubes 42 therein. Next, the sockets 40 of brackets 38 at the front (or rear) of the frame section 36 are engaged on, and secured to, the side rails 36*c* therein by fasteners 41*a*, 41*b*. Then, the frame base 22 is positioned on the floor or ground and the top section 36, with bag 12 attached as aforesaid, is positioned on the fork of a forklift and raised high enough so that the loops 52 at the bottom of bag 12 can be engaged on the legs 24 of base 22 and so that the four columns 32 can be plugged into the legs 24 of base 22 and so that the tube segments 42*a* at the four corners of top section 36 can be plugged into the tops of columns 32. Finally, section 36 is lowered and seated on columns 32 to complete the assembly.

When the container is in use, small parts may be tossed into the open top of the container until the container is full. Larger parts may require that the fasteners 16*a*, 16*b* be released and the closure 14 opened and resecured from the bottom up as the container is filled. The containers can be stacked at least three high so that many filled containers can fit inside a conventional truck, trailer, sea container or the like.

To remove parts from container 12, the top fasteners 16*a*, 16*b* are released and parts removed through opening 15. As additional parts are removed, the fasteners further down on the bag may be released until the bag is empty.

To disassemble the container, the fork of a forklift is inserted under bag 12 but above base 22 and the fork raised to collapse the bag and to lift the top section 36 to separate the top section 36 from columns 32. After the columns are removed from base 22, the top section with the collapsed bag is lowered so that the tube segments 42*a* of top section 36 plug into the legs 24 of base 22 and the columns 32 are secured for transport. With the top section plugged into the bottom section as aforesaid, the total height of the collapsed frame sections is less than two feet high and those sections can be stacked five units high in 18 stacks so that a total of 900 collapsed units may be shipped in a standard 53 foot trailer.

When bag 12 is filled with protruding parts or a particularly heavy load, it may be desirable to reinforce bag 12. This can be accomplished easily by engaging one or more reinforcing skirts on frame 10 at the time of assembly. Such a skirt is shown in phantom at 78 in FIG. 1. It comprises a sheet 82 of bag material having vertical sleeves 82 at opposite side edges for engagement on columns 32 outboard bag 12.

It will thus be seen that the object set forth above, among those made apparent from the preceding description, are efficiently attained. Also, certain changes may be made in the above construction without departing from the scope of the invention. For example, the rails of the top section 36 could be permanently secured to corner brackets 38 and the hems 54*a* to 54*c* and bag walls fitted with releasable fasteners, i.e., buckles, snaps, etc., in order to open the hems to install bag 12 on top section 36. Therefore, it is intended that all matter contained in the above description or shown in the accompanying drawings be interpreted as illustrative and not in a limiting sense.

It is also to be understood that the following claims are intended to cover all of the generic and specific features of the invention described herein.

What is claimed is:

1. A collapsible shipping and storage container comprising a collapsible frame including a rectangular base having four rails and upstanding tubular legs connecting the rails at the corners of the base, a rectangular top section having substantially the same outside dimensions as said base, said top section including four rails and upstanding corner brackets connecting the rails at the corners of the top section, said brackets having lower segments extending below the rails of said top section and upper segments extending above the rails of said top section, and four tubular columns, the cross sections of said legs, columns, and bracket lower segments being sized relatively such that the lower ends of said columns can telescope into said legs and the lower segments of said brackets can telescope selectively into either the upper ends of said columns or said legs, and a flexible bag having an open upper end releasably suspended from said top section and a closed lower end.

2. The container defined in claim 1 wherein the legs of said base have lower ends extending below the rails of said base, and further including feet connected to the lower ends of said legs.

3. The container defined in claim 1 wherein said legs have square cross sections.

4. The container defined in claim 3 wherein said columns and said bracket lower segments have circular cross sections.

5. The container defined in claim 4 wherein said rails have circular cross sections.

6. The container defined in claim 1 wherein each bracket of said top section comprises an upstanding tubular post;

a pair of orthogonal sockets extending out perpendicularly from said posts for receiving the ends of the rails at the corresponding corner of the top section;

securing means for releasably securing said rails ends in said sockets;

a pipe extending through said post, and means for fixing said pipe to said post so that the lower end of the pipe projects below said post and constitutes said lower segment of the bracket.

7. The container defined in claim 6 wherein said pipe has a circular cross section, and said post has a square cross section and constitutes a stop when said lower segments of said brackets are telescoped into said columns or into the legs of said base.

8. The container defined in claim 6 wherein said securing means comprise at least one threaded fastener.

9. The container defined in claim 6 wherein said pipe has an upper segment which extends above said post, and each leg of said base has a foot which is adapted to receive and retain said upper segment of the pipe of another similar container so that a plurality of said containers can be stacked stably.

10. The container defined in claim 1 wherein said base further includes a plurality of rigid intersecting stringers connected between the opposite rails of the base so as to intersect, said stringers being connected together at their intersections.

11. The container defined in claim 1 wherein said bag includes four walls having hems at their upper edges releasably suspended from the four rails of said top section, said walls extending from said top section substantially to said base when said top section is telescopically connected to said base via said columns.

12. The container defined in claim 11 and further including means defining an opening in one of said walls extending from the top of said one of said walls to a location near the lower end of the bag, said opening having opposite side edges, closure means attached to said one of said walls, said closure means being movable between a closed position wherein the closeable means cover said opening and a fully open position revealing said opening, and fastener means for releasably sewing said closure means in said closed position.

13. The container defined in claim 12 wherein said closure and fastener means include a flexible flap having one side edge attached to one of said walls adjacent to one of said opening edges and an opposite side edge facing the other of said opening side edges, and two series of cooperating fasteners attached to said opposite side edge and to said other of said opening side edges, respectively, at similarly spaced apart locations along said edges.

14. The container defined in claim 13 wherein one series of fastener means comprise buckles and the other series of fastener means comprise straps adapted to be engaged to corresponding ones of said buckles.

* * * * *